United States Patent [19]

Budecker et al.

[11] Patent Number: 4,758,134

[45] Date of Patent: Jul. 19, 1988

[54] RADIAL PISTON MACHINE

[75] Inventors: Ludwig Budecker, Frankfurt am Main; Georg Obersteiner, Frankfurt, both of Fed. Rep. of Germany

[73] Assignee: ITT Industries, Inc., New York, N.Y.

[21] Appl. No.: 365,212

[22] Filed: Apr. 5, 1982

[30] Foreign Application Priority Data

May 29, 1981 [DE] Fed. Rep. of Germany ..... 3121527

[51] Int. Cl.[4] ..... F04B 29/00

[52] U.S. Cl. ..... 417/462; 417/271

[58] Field of Search ..... 417/271, 363, 462; 91/491, 492

[56] References Cited

U.S. PATENT DOCUMENTS

| | | | |
|---|---|---|---|
| 1,525,026 | 2/1925 | Dickerman | 464/51 |
| 2,484,321 | 10/1949 | Stubau | 464/77 |
| 2,712,794 | 7/1955 | Humphreys | 91/492 |
| 2,741,993 | 4/1956 | Orshansky, Jr. | 91/486 |
| 2,809,594 | 10/1957 | Orshansky, Jr. | 91/486 |
| 2,811,867 | 11/1957 | Hogborg | 464/51 |
| 2,922,369 | 1/1960 | Nystrom | 417/462 |
| 2,928,961 | 3/1960 | Morrill | 417/363 |
| 3,695,147 | 10/1972 | Siesennop | 91/498 |
| 3,750,533 | 8/1973 | Thoma | 91/498 |
| 3,752,138 | 8/1973 | Gaines | 417/462 |
| 3,955,476 | 5/1976 | David | 91/491 |
| 3,982,856 | 9/1976 | Hehl | 417/363 |
| 4,357,925 | 11/1982 | Woodruff | 417/462 |

FOREIGN PATENT DOCUMENTS

| | | | |
|---|---|---|---|
| 1437743 | 6/1974 | United Kingdom | 417/462 |

*Primary Examiner*—William L. Freeh

*Attorney, Agent, or Firm*—James B. Raden; Robert P. Seitter

[57] ABSTRACT

A radial piston pump includes an axially slidable rotor which is rotatably connected to a connected shaft through a spring clutch engaging one end face of the rotor. The rotor is located in a housing or in the stator so as to constitute a frontal gap between the rotor and the housing or stator on the pressure side of the machine, through which frontal gap, during operation of the device, pressure fluid of the pressure side is permitted to be supplied to at least one sector area of that end face of the rotor opposite the spring clutch. This causes centering of the rotor by the spring clutch and by the pressure of the pressure side in such a manner that no metallic contacts occur in an axial direction and, thus, no friction losses.

3 Claims, 2 Drawing Sheets

FIG. 2
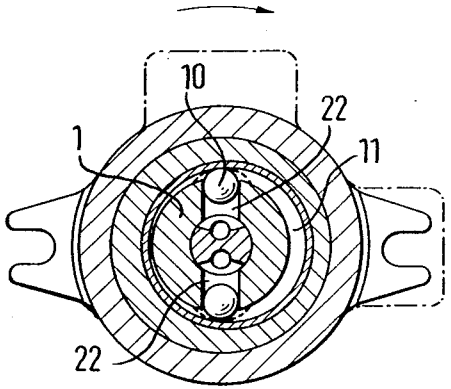
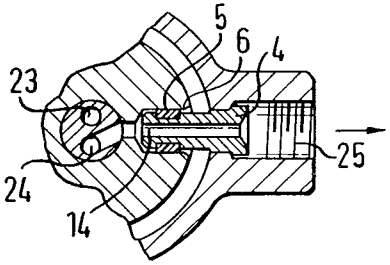
FIG. 3
FIG. 1
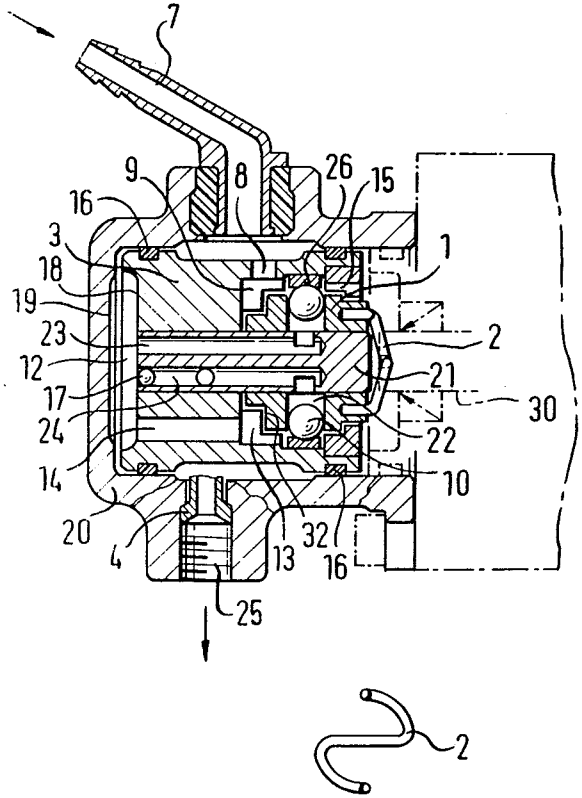

RADIAL PISTON MACHINE

BACKGROUND OF THE INVENTION

The present invention relates to a radial piston machine, and more particularly to a radial piston pump including a stator and a rotor, the rotor being rotatable with a connected shaft situated in a coaxial extension of the rotor through a spring clutch engaging one end face of the rotor.

In a radial piston machine of the construction initially referred to, known from German Patent DE-AS No. 2,334,138, there is interposed between connected shaft and rotor a spring clutch having the shape of a preloaded compression spring for a torsionally elastic engagement, in order to achieve good attenuation of the noise occurring in operation, which noise is produced by vibrations of single members caused by pressure pulsation. By virtue of the preloading force of the compression spring, an axial force is exerted on the rotor which will be received by a collar of a component fastened with the housing, with the rotor and the component fastened with the housing being in metallic contact and thus causing friction loesses in operation which impair the efficiency particularly in radial piston machines of lower capacity.

SUMMARY OF THE INVENTION

It is an object of the present invention to provide a radial piston machine of simple construction in which, while little noise develops during operation, practically no friction losses occur in an axial direction of the rotor.

A feature of the present invention is the provision of a radial piston machine comprising a stator; and a rotor axially slidably received in a selected one of a housing and the stator, the rotor being rotatable by a connected shaft through a spring clutch engaging one end face of the rotor, the other end face of the rotor being acted upon by outlet-pressure of the machine, the spring clutch and the outlet pressure axially positioning the rotor to prevent axial friction contact between the rotor and the selected one of the housing and the stator.

This arrangement causes centering of the rotor in an axial direction by the clutch constructed as a spring and by a hydraulic pressure acting on the opposite end face of the rotor in such a manner that there occurs no metallic contacts in an axial direction and, thus, no friction losses. This will decisively improve the efficiency of a radial piston machine, in particular of a low-capacity machine, and assist in an operation at a low noise level. It is a particular advantage of this invention that the spring clutch is loaded minimally by the bias when the machine is not operated, especially in the event of a compression spring being provided as the spring clutch.

Expediently, the area of the other end face of the rotor is formed by a sector area which is spatially isolated from the suction side of the machine.

In particular, the sector area of the rotor amounts to approximately 180° which area is available to be subjected to the charging pressure of the machine.

In a favorable improvement of the present invention, the rotor contains at least two radial bores having guided in them radial piston elements-which are adapted to be brought into engagement with the cam curve of the stator.

In particular, the radial piston element is a ball rolling on the cam curve of the stator, with the cam curve having a concave shape corresponding to the ball diameter, when viewing the axial section of the stator.

Alternatively, the radial piston element rolling on the cam curve of the stator may be of roller-like construction.

Likewise, the radial piston element can be in sliding engagement with the cam curve.

Suitably, the rotor is supported axially slidably on a control pintle containing at least one first internal bore which is connectible to the radial bore with a view to pressurizing the radial piston element when the latter is located in a rotary position in the area of the suction side of the machine.

In addition, the control pintle of the rotor contains at least one second internal bore communicating with the pressure port of the machine, which second internal bore is connectible to the radial bore of the rotor when the radial piston element is located in a rotary position in the area of the pressure side of the machine.

A compact construction and operation at a low noise level will result if the inner rotor and outer stator are contained in a construction unit which is inserted in the housing by means of elastic and sealing means, with the stator being coupled to the housing in a torsionally and axially secure, but elastic fashion.

Suitably, there is fitted in the pressure port of the machine a radial intermediate member including a radial passageway, by which member the stator is torsionally secured and elastically held. In particular, the radial intermediate member is sealed at the stator by an elastic O-ring, the O-ring taking support on a back ring. The elastic suspension serves specially for noise diminution.

The elastic and sealing means of the construction unit comprising stator and rotor are expendiently two O-rings which are supported on the stator by back rings, with the radial suction port of the machine being interposed between the O-rings.

The cam curve will advantageously be the inner circumference of a cam ring which is inserted in a stator portion. When using a spherical piston element, the cam ring is supported axially slidably in the stator portion.

In an alternative manner, the cam curve can be the inner circumference of a cam ring which is inserted in the housing. Also in this case, the cam ring will be axially slidable in the housing in the event of provision of a spherical radial piston element.

BRIEF DESCRIPTION OF THE DRAWING

Above-mentioned and other features and objects of this invention will become more apparent by reference to the following description taken in conjunction with the accompanying drawing, in which:

FIG. 1 is a longitudinal cross sectional view of a first embodiment of a radial piston or spherical pump in accordance with the principles of the present invention;

FIG. 2 is a transverse cross sectional view of the pump of FIG. 1 taken through the middle of the rotor;

FIG. 3 is a partial transverse cross sectional view of another detail of the pump of FIG. 1;

DESCRIPTION OF THE PREFERRED EMBODIMENTS

Figure 5:
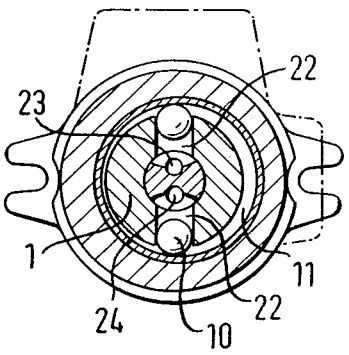
FIG. 5 is a transverse cross sectional view of the pump of FIG. 4 taken through the middle of the rotor.

FIG. 1 shows a radial piston or spherical pump in a cup-type housing 20, closed at the one end face 19, in which housing is received a construction unit in a torsionally and axially secured but elastic fashion by means of two elastic and sealing means 16 constructed as O-rings and associated back rings. The elastic suspension of the construction unit serves for noise reduction during operation.

The construction unit is substantially composed of an outer stator having a stator portion 3 which supports a concentric control pintle 21 as well as an axially slidable rotor 1 supported rotatably on control pintle 21, rotor 1 containing radial bores 22 for accommodation of spherical radial piston elements 10 which, during operation, roll on an outer cam ring of the stator which is conformed to the balls 10, stationary and located eccentrically relative to rotor 1. The cam ring is supported axially slidably in the stator.

One end face (according to FIG. 1 the right end face) of rotor 1 includes diametral blind-end bores in which engage the straight ends of a torsionally and axially elastic spring clutch 2, clutch 2 in turn being connected in a torsionally secured manner to a connected shaft 30 of a motor, for instance an electric motor, as shown in FIG. 1 by dot-dash lines. When the construction unit is mounted, the spherical pump with its cup-type housing 20 is flanged to the motor by which the pump is driven.

The spherical pump possesses a suction socket with a radial suction port 7 supplying hydraulic fluid in between the elastic sealing means 16, via a radial bore 8 in the stator, to the suction side of the pump. On a level with the suction side 9 and on the other side of the cam ring, the stator has a milled-in passageway 15 providing hydraulic communication between the end face of the rotor engaging the spring clutch 2 and the suction side 9 of the pump.

Further, the spherical pump includes a radial pressure port 25 which is located at a suitable point on the periphery of the pump between the elastic and sealing means 16. Inserted in the pressure port 25 is, as is shown in detail in FIG. 3, a radial intermediate member 4 having a radial passageway 14, member 4 engaging in an associated radial recess of the stator which contains a radial passageway leading to the central control pintle 21 via an elastic O-ring 5, the latter taking support on a back ring 6. The elastic support formed by O-ring 5 and back ring 6 prevents a direct metallic contact between stator and intermediate member 4 and thus a transmission of sound conducted through solids. Simultaneously, the support serves in addition to the elastic means 16 to receive the torque which is exerted on the stator during operation and takes care that the construction unit is entirely supported in a torsionally secured manner in the pump housing 20, the elasticity of torsion being precisely calculable.

Diametrically relative to the suction side 9, the stator includes a charging pressure side 13 which is connected to an axial passageway 14 of the stator which in turn leads to the frontal bottom of the housing 20. The end wall 18, close to the end face 19 of the housing 20, of the construction unit is spaced in an axial direction from the housing bottom, a compartment being formed thereby which communicates with the charging pressure side 13 of the pump.

In the area of the charging pressure side 13, the stator is circumferentially recessed in a manner such as to constitute a gap between rotor 1 and stator allowing a sector area of the end face 32 (according to FIG. 1 left end face) of the rotor 1 to be acted upon by the charging pressure during operation. In the embodiment according to FIG. 1, the area of pressurization amounts to approximately 180° and comprises the entire rotor ring in a radial extension.

The central control pintle 21, stationary relative to the stator, contains a first axial internal bore 23 which communicates with the radial bore 22 of the rotor 1 when the spherical piston element 10 allocated to the radial bore 22 is situated on the suction side (according to FIG. 2 above the longitudinal axis). Besides, the control pintle 21 contains a second axial internal bore 24 which communicates with the radial bore 22 of the rotor when the associated piston element 10 assumes a rotary position which corresponds to the pressure side of the pump (according to FIG. 2 below the longitudinal axis). The second internal bore 24 is isolated by a plug 17 from the compartment 12 and is connected via a radial port with the pressure port 25, as has been illustrated in FIG. 3.

The mode of operation of the spherical pump will now be described.

When the connected shaft 30 of an electric motor (not shown) is driven, the elastic spring clutch 2 causes rotation of rotor 1, while the spherical piston elements 10 roll on the outer cam ring under the action of centrifugal force. By virtue of the eccentricity between rotor and stator, an outer working chamber 11 variable in volume is formed according to FIG. 2 so that hydraulic fluid is sucked in through the suction port 7 to the suction side 9, is pressurized in the working chamber 11 and discharged on the pressure side 13. Since the pressure side 13 extends over about 180° of the rotor and because of a gap being formed between rotor and stator in the area of the pressure side, a sector area of the end face 32 of rotor 1 is acted upon by pressure fluid and exerts a hydraulic pressure in the direction of the spring clutch 2. As a result thereof rotor 1, which is axially slidable on control pintle 21 is centered in an axial direction and is held clear of contact relative to the stator. Therefore, axial friction losses do not occur owing to the above-described position of rotor 1 in the axial direction which permits the pump to be operated efficiently. The pressure fluid of the pressure side 13 is fed through the axial passageway 14 to the compartment 12 and from there through the first internal bore 23 of the control pintle 21 into the radial bore 22 of a piston element 10 disposed on the suction side so that piston element 10 is urged radially against the outer cam ring by, in addition to the centrifugal force, the pump pressure generated. As the piston element 10 rotates from the suction side to the pressure side, the pressure fluid in radial bore 22 is supplied to the second internal bore 24 of the control pintle 21 and propagates from there through the pressure port 25 to the slave unit.

Figure 4:
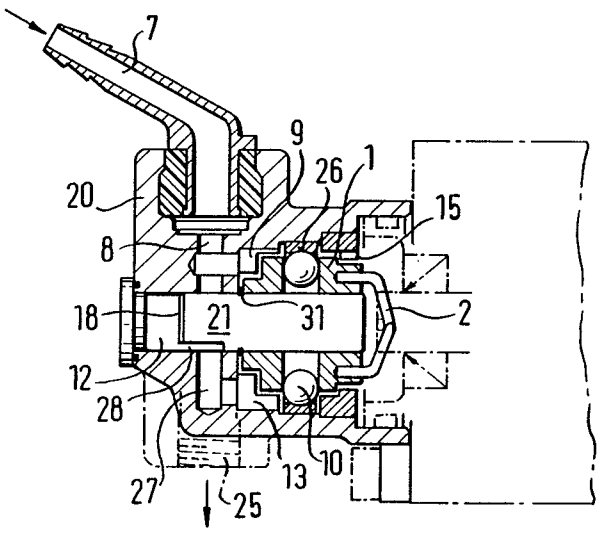
FIG. 4 is a longitudinal cross sectional view of a second embodiment of a radial piston or spherical pump in accordance with the principles of the present invention.

The embodiment of another spherical pump illustrated in FIGS. 4 and 5 corresponds in its principal construction to the spherical pump of FIGS. 1 through 3. Like parts have been assigned like reference numerals.

In contrast to the first embodiment, there is no provision of a construction unit comprising stator and rotor which is elastically received in the machine housing damping the sound conducted through solids. Rather the cam curve which is conformed in an axial direction to the cross-section of the spherical piston element 10 is supported axially slidably in housing 20.

The hydraulic fluid is sucked in during operation through the suction port 7 as in the case of the embodiment according to FIGS. 1 through 3, is pressurized in the working chamber 11 and discharged on the pressure side 13, while a counterpressure to the axial pressure of the spring clutch 2 develops on the end face 32 of rotor 1 which maintains the rotor 1 in an axial direction clear of contact with the machine housing 20. The pressure fluid of the pressure side 13 is fed through a passageway 27 of the housing 20 and a (not shown) radial bore of the control pintle to the first internal bore 23 and from there into the radial bore 22 of a piston element 10 disposed on the suction side. After a half rotation of the piston element 10 from the suction side to the pressure side, the pressure fluid in the radial bore 22, as is the case in the first embodiment, will be supplied to the second internal bore 24 of the control pintle 21 and subsequently led to the pressure port 25 of the slave unit. The pressure port 25 is placed on the housing in a circumferentially offset manner so that the latter's connecting channel leading to the second internal bore 24 of the control pintle 21 does not intersect the passageway 27. Likewise, the passageway 27 can be located outside the drawing plane of FIG. 4.

While we have described above the principles of our invention in connection with specific apparatus, it is to be clearly understood that this description is made only by way of example and not as a limitation to the scope of our invention as set forth in the objects thereof and in the accompanying claims.

We claim:

1. A radial piston machine comprising a housing including stationary structure enclosing a rotor having a pair of axial ends, a driving shaft for said machine connected by a spring clutch to one axial end of said rotor, an inlet port and an output port respectively positioned on diametrically opposed sides of the rotor, said inlet and outlet ports being joined by a pressure passage through said rotor for the flow of pumping pressure from said inlet port to said outlet port, the other axial end of said rotor having an end wall formed with a recess bounded by a radially directed portion of said end wall of said other end of said rotor, said end wall of said rotor being located so as to be receptive of charging pressure to apply an axial bias on the rotor directed toward the spring clutch, the clutch connection applying an axial bias on the rotor directed toward the other end face whereby the net effect of said applied axial bias of said spring clutch and of the charging pressure acting on said end wall with the shaft rotating is to position said rotor axially to prevent axial friction contact between said rotor and said stationary structure.

2. A radial piston machine as claimed in claim 1, in which said stationary structure comprises a stator enclosing said rotor within said housing.

3. A radial piston machine as claimed in claim 1, in which said stationary structure is integral with the housing.

* * * * *